US007714692B2

(12) United States Patent
Lee

(10) Patent No.: US 7,714,692 B2
(45) Date of Patent: May 11, 2010

(54) THERMAL OVERLOAD TRIP APPARATUS AND METHOD FOR ADJUSTING TRIP SENSITIVITY THEREOF

(75) Inventor: Kyung-Ku Lee, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 111 days.

(21) Appl. No.: 12/178,118

(22) Filed: Jul. 23, 2008

(65) Prior Publication Data

US 2009/0040004 A1 Feb. 12, 2009

(30) Foreign Application Priority Data

Aug. 7, 2007 (KR) ..... 10-2007-0079234

(51) Int. Cl.
*H01H 71/74* (2006.01)
*H01H 71/16* (2006.01)

(52) U.S. Cl. ..... 337/84; 337/36; 337/37; 337/82; 335/35; 335/45; 335/145; 335/173

(58) Field of Classification Search ..... 337/36, 337/37, 82, 84; 335/35, 45, 145, 173
See application file for complete search history.

(56) References Cited

U.S. PATENT DOCUMENTS 3,015,007 A * 12/1961 Howard ..... 337/56
3,038,051 A * 6/1962 Howard ..... 337/62
3,162,739 A * 12/1964 Klein et al. ..... 335/9
3,183,328 A * 5/1965 Wheeler ..... 337/56
3,214,535 A * 10/1965 Koenig et al. ..... 335/37
3,251,966 A * 5/1966 Kussy et al. ..... 337/45
3,423,712 A * 1/1969 Howard ..... 337/77
3,588,761 A * 6/1971 Heft et al. ..... 335/16
4,603,312 A * 7/1986 Conner ..... 335/42
4,635,020 A * 1/1987 Sako ..... 337/49

(Continued)

FOREIGN PATENT DOCUMENTS

DE 828745 1/1952

(Continued)

OTHER PUBLICATIONS

U.S. Appl. No. 12/178,141 to Song, which was filed on Jul. 23, 2008.

*Primary Examiner*—Anatoly Vortman
(74) *Attorney, Agent, or Firm*—Greenblum & Bernstein, P.L.C.

(57) ABSTRACT

A thermal overload trip apparatus capable of minimizing inferiority caused by variations during manufacturing of an adjusting means and simply adjusting sensitivity by duplicating the means for adjusting a sensitivity to a trip operation current, comprising: a trip mechanism driven to a trip position by a driving force from a shifter mechanism on occurrence of an overload in a circuit; a release lever mechanism for driving the trip mechanism to the trip position by pressing it when there is the driving force from the shifter mechanism or for releasing the trip mechanism when there is no driving force, on occurrence of the overload in the circuit; an adjusting lever for operating the release lever mechanism to be horizontally moved by rotation; an adjusting knob having an upper surface having a setting groove and a lower portion having a cam portion; and a means independently adjusting the sensitivity to the trip operation current regardless of manipulation of the adjusting knob.

8 Claims, 3 Drawing Sheets

U.S. PATENT DOCUMENTS

| | | | | | |
|---|---|---|---|---|---|
| 4,652,847 | A * | 3/1987 | Sako | 337/49 |
| 4,763,096 | A * | 8/1988 | Ingrain | 337/82 |
| 4,785,274 | A * | 11/1988 | Sako et al. | 337/49 |
| 4,808,961 | A * | 2/1989 | Sako et al. | 337/49 |
| 4,922,220 | A * | 5/1990 | Livesey et al. | 337/82 |
| 4,983,939 | A * | 1/1991 | Shea et al. | 335/42 |
| 5,054,754 | A * | 10/1991 | Akiike et al. | 267/159 |
| 5,793,026 | A * | 8/1998 | Kolberg et al. | 335/172 |
| 5,831,501 | A * | 11/1998 | Kolberg et al. | 335/42 |
| 5,831,509 | A * | 11/1998 | Elms et al. | 337/333 |
| 5,877,670 | A * | 3/1999 | Sehlhorst et al. | 337/302 |
| 5,894,259 | A * | 4/1999 | Kolberg et al. | 337/333 |
| 6,104,273 | A * | 8/2000 | Larranaga et al. | 337/82 |
| 6,160,470 | A * | 12/2000 | O'Carroll et al. | 337/82 |
| 6,225,881 | B1 * | 5/2001 | Felden et al. | 335/172 |
| 6,445,274 | B1 * | 9/2002 | Malingowski et al. | 337/49 |
| 6,459,355 | B1 * | 10/2002 | Furuhata et al. | 337/52 |
| 6,496,097 | B2 * | 12/2002 | Frank | 337/323 |
| 6,507,266 | B1 * | 1/2003 | Bizard et al. | 337/349 |
| 6,621,403 | B2 * | 9/2003 | Nagahiro et al. | 337/75 |
| 6,661,329 | B1 * | 12/2003 | Gibson | 337/84 |
| 6,720,856 | B1 * | 4/2004 | Pellon et al. | 337/82 |
| 6,816,055 | B2 * | 11/2004 | Weber | 337/82 |
| 7,135,953 | B2 * | 11/2006 | Leitl et al. | 337/84 |
| 7,248,140 | B2 * | 7/2007 | Yu | 337/94 |
| 7,372,356 | B2 * | 5/2008 | Lee | 337/360 |
| 2006/0077022 | A1 | 4/2006 | Kim | |
| 2007/0075047 | A1 | 4/2007 | Oh | |
| 2007/0075808 | A1 | 4/2007 | Ahn | |
| 2008/0122563 | A1 * | 5/2008 | Song | 335/176 |

FOREIGN PATENT DOCUMENTS

| | | | |
|---|---|---|---|
| DE | 1984178 | | 4/1968 |
| DE | 2152002 | | 3/1973 |
| DE | 3544989 | A1 * | 7/1987 |
| GB | 1441350 | | 6/1976 |
| JP | 2009043727 | A * | 2/2009 |
| WO | 2005/104160 | | 11/2005 |

* cited by examiner

THERMAL OVERLOAD TRIP APPARATUS AND METHOD FOR ADJUSTING TRIP SENSITIVITY THEREOF

BACKGROUND OF THE INVENTION

1. Field of the Invention

The present invention relates to a thermal overload trip apparatus which is applicable to an electrical device for protecting a motor and an electrical load device, such as a thermal overload relay or a manual motor starter, more particularly, to a thermal overload trip apparatus which is capable of efficiently adjusting a sensitivity thereof using an adjusting screw without adjusting an adjusting knob and a method for adjusting a trip sensitivity thereof.

2. Description of the Related Art

An overload protecting function, a basic function of a thermal overload trip apparatus, is implemented by performing a trip operation when an overload or overcurrent within a current range satisfying a pre-set condition for the trip operation is generated in an electric circuit. The current range may refer to a current range for the trip operation according to an IEC (International Electrotechnical Commission) standard specified as an international electrical standard. For example, a condition for the trip operation is that the trip operation should be performed within two hours when a current corresponding to 1.2 times of a rated current is conducted in a circuit and the trip operation should be performed more than two hours and within several hours when a current corresponding to 1.05 times of the rated current is conducted.

The thermal overload (overcurrent) trip apparatus generally includes a heater coil generating heat when an overcurrent is generated by being connected onto the circuit and positioned near the bimetals so as to provide a driving force for a trip operation by said bimetals being bent when the heater coil generates heat, so as to act as a driving actuator. One example of the thermal overload trip apparatus using the bimetals will be described with reference to FIGS. 1 and 2.

FIG. 1 is a diagram showing a configuration of a thermal overload trip apparatus in accordance with the related art, and FIG. 2 is a diagram showing a relation between an adjusting cam and a trip sensitivity adjusting range in the thermal overload trip apparatus in accordance with the related art.

In FIG. 1, a reference numeral 1 designates bimetals. Here, three bimetals are provided so as to be connected onto each circuit of three-phase Alternating Current. Thus, the bimetals are bent by heat from a heater coil (not shown) generating heat when an overcurrent is generated, and accordingly provide a driving force for a trip operation. A reference numeral 2 designates a shifter mechanism. The shifter mechanism 2 is a means for transferring the driving force for the trip operation from the bimetals 1 and is movable in a horizontal direction on the drawing by contacting the bimetals 1 in right and left directions so as to receive the driving force caused by the bent bimetals 1. In FIG. 1, a reference numeral 3 designates a trip mechanism. The trip mechanism is biased to be rotated in a direction of the trip operation by a spring (reference numeral not given). In FIG. 1, a reference numeral 4 designates a latch mechanism for releasing the trip mechanism 3 to be rotated in the direction of the trip operation or restricting the trip mechanism 3 not to be rotated in the direction of the trip operation. The latch mechanism 4 has one end portion installed to face a driving force transfer portion of the shifter mechanism 2 with each other so as to receive the driving force from the shifter mechanism 2, another end portion disposed on a rotation locus of the trip mechanism 3 so as to restrict or release the trip mechanism 3, and a middle portion therebetween supported by a rotation shaft (reference numeral not given) to be rotatable. A reference numeral 6 designates a contact point between the trip mechanism 3 and the latch mechanism 4 at the restriction position. In FIG. 1, at a position contacting one portion of the latch mechanism 4, an adjusting knob mechanism 5 is disposed to be rotatable so as to displace the latch mechanism 4 to be closer or to be distant to/from the shifter mechanism 2 resulting from changes of a contact pressure while contacting the latch mechanism 4. Here, the adjusting knob mechanism 5 includes a cam portion 9 having a varying radius of curvature of its outer circumstance, and an adjusting knob 10 coupled to the cam portion 9 or integrally extended from the cam portion 9 so as to rotate the cam portion 9. In FIG. 1, a reference character y indicates a bending displacement (bending amount) of the bimetals and indicates a pre-set displacement amount (distance) of the bending bimetals 1 when a pre-set overcurrent is conducted in the circuit. And, a reference numeral $\Delta y$ indicates an allowance for trip operation and indicates a pre-set gap between the shifter mechanism 2 and the latch mechanism 4 when the shifter mechanism 2 is displaced by the pre-set bending amount y of the bimetals 1 caused by generation of the pre-set overcurrent. The allowance for trip operation is adjustable by the adjusting knob mechanism 5.

In the meantime, referring to FIG. 2, a configuration of the cam portion 9 included in the adjusting knob mechanism 5 in accordance with the related art will be described.

In FIG. 2, a reference character a indicates a cam adjustable range covering angles between a maximum trip operation insensitive adjusting position 12 and a maximum trip operation sensitive adjusting position 13. However, since a manufacturer of the thermal overload trip apparatus in the related art has adjusted an initial position of the cam portion 9 such as an initially-set position for the cam portion 11 by rotating the adjusting knob 10 of FIG. 1 during manufacturing, a range allowing a user to substantially adjust the rotation angle of the cam portion 9 is a substantially-adjustable range for the cam b. In FIG. 2, a reference character c indicates an initially-set adjusting range for the cam.

Operation of the thermal overload trip apparatus in accordance with the related art will be described.

First, the trip operation will be described. When the heater coil (not shown) generates heat by the overcurrent in the circuit, the bimetals 1 are bent and moved rightward on the drawing. Accordingly, the shifter mechanism 2 is moved rightward on FIG. 1, that is in a shifter mechanism operating direction 7 applied when the overcurrent is generated by a value obtained by adding the allowance for trip operation $\Delta y$ to the bending amount y by the driving force of the bimetals 1 bent more than the value adding the allowance for trip operation $\Delta y$ to the bending amount y, accordingly the latch mechanism 4 is pressed rightward and then rotated in a counterclockwise direction on the drawing. Then, the trip mechanism 3 restricted by the latch mechanism 4 is released and then rotated in the tripping direction, that is in the counterclockwise direction by an elastic force of a spring (reference numeral not given), and accordingly a succeeding switching mechanism (not shown) is operated into a trip (circuit-opening) position and then the circuit is tripped (broken), thereby protecting the circuit and a load device.

Next, a sensitivity adjusting operation for the trip operation will be described with reference to FIGS. 1 and 2.

Under a state that the initial position of the cam portion 9 is adjusted by a manufacturer such as the initially-set position for the cam portion 11 in FIG. 2, if the user rotates the cam portion 9 of FIG. 1 in the counterclockwise direction, the latch mechanism 4 is rotated clockwise, centering the rotation shaft (reference numeral not given), that is in a trip operation sensitivity sensitive adjusting direction 8, accordingly the allowance for trip operation Δy becomes narrow and the trip operation sensitivity of the device with respect to the overcurrent becomes more sensitive.

Since the thermal overload trip apparatus in accordance with the related art has a configuration that the trip operation sensitivity is adjusted only by the cam portion and the latch mechanism, it is difficult to precisely specify relative positions between the cam portion and the latch mechanism and a driving force transfer structure thereof and relative positions between the latch mechanism and the shifter mechanism and a driving force transfer structure thereof and to install the apparatus based on a standard. Thus, the thermal overload trip apparatus in accordance with the related art has a possibility to cause defects during manufacturing that there is no allowance for trip operation or the tripping operation is not performed even if the cam portion is rotated to the maximum sensitive position.

And, since the thermal overload trip apparatus in accordance with the related art has a structure requiring disassembling and re-adjusting the relative positions between the components and the driving force transfer structure thereof when the defectiveness occurs in the manufacturing processes, it may deteriorate productivity of manufacturing.

SUMMARY OF THE INVENTION

Therefore, the present invention is directed to providing a thermal overload trip apparatus which is capable of simply adjusting a trip operation sensitivity without disassembling and reassembling processes of components even if defectiveness occurs while adjusting the trip operation sensitivity.

It is another object of the present invention to provide a method for adjusting a trip sensitivity of a thermal overload trip apparatus which is capable of simply adjusting a trip operation sensitivity without disassembling and reassembling processes of components even if defectiveness occurs while adjusting the trip operation sensitivity.

To achieve these and other advantages and in accordance with the purpose of the present invention, as embodied and broadly described herein, there is provided a thermal overload trip apparatus, in the thermal overload trip apparatus having bimetals for providing mechanical displacement according to an overload on a circuit and a shifter mechanism for transferring the mechanical displacement of the bimetals as a driving force, the apparatus comprising: a trip mechanism driven to a trip position by the driving force from the shifter mechanism when the overload is generated in the circuit; a release lever mechanism having one portion rotatably installed to contact the shifter mechanism so as to receive the driving force from the shifter mechanism and another portion installed to contact the trip mechanism, so that the release lever mechanism press the trip mechanism and drive the trip mechanism to the trip position when there is the driving force from the shifter mechanism, or the release lever mechanism release the trip mechanism when there is no driving force from the shifter mechanism, when the overload is generated in the circuit; an adjusting lever having a portion for rotatably supporting the release lever mechanism so as to operate the release lever mechanism to be horizontally moved by the rotation; an adjusting knob having an upper surface provided with a setting groove and a lower portion provided with a cam portion so as to set a trip operation position according to a rated current; and a means connected to the adjusting lever to rotate the adjusting lever so as to independently adjust a sensitivity to the trip operation current regardless of manipulation of the adjusting knob.

Another aspect of the present invention is to provide a method for adjusting a trip sensitivity of a thermal overload trip apparatus, in the thermal overload trip apparatus comprising bimetals for providing a mechanical displacement according to an overload in a circuit, a shifter mechanism for transferring the mechanical displacement of the bimetals as a driving force, a trip mechanism reversed to a trip position by the driving force from the shifter mechanism when the overload is generated in the circuit, a release lever mechanism having one portion rotatably installed to contact the shifter mechanism so as to receive the driving force from the shifter mechanism and another portion installed to contact the trip mechanism, so that the release lever mechanism presses the trip mechanism and drive the trip mechanism to the trip position when there is the driving force from the shifter mechanism, or the release lever mechanism releases the trip mechanism when there is no driving force from the shifter mechanism, when the overload is generated in the circuit, an adjusting lever having a portion for rotatably supporting the release lever mechanism so as to operate the release lever mechanism to be horizontally moved by the rotation, an adjusting knob having an upper surface provided with a setting groove and a lower portion provided with a cam portion so as to set a trip operation position according to a rated current, and a means connected to the adjusting lever to rotate the adjusting lever so as to independently adjust sensitivity to the trip operation current regardless of manipulation of the adjusting knob, the method comprising: setting an initial position of the adjusting knob; assembling components forming the thermal overload trip apparatus; conducting a predetermined over current to the thermal overload trip apparatus assembled in the assembling step for a predetermined time; adjusting the adjusting screw by rotating the adjusting screw until a trip operation occurs under a state that the adjusting knob is maintained at the initially set position; and marking the rated current at a periphery of the adjusting knob.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate preferred embodiments of the invention and together with the description serve to explain the principles of the invention.

In the drawings.

DETAILED DESCRIPTION OF THE INVENTION

Description will now be given in detail of the preferred embodiments of the present invention, examples of which are illustrated in the accompanying drawings.

Figure 1:
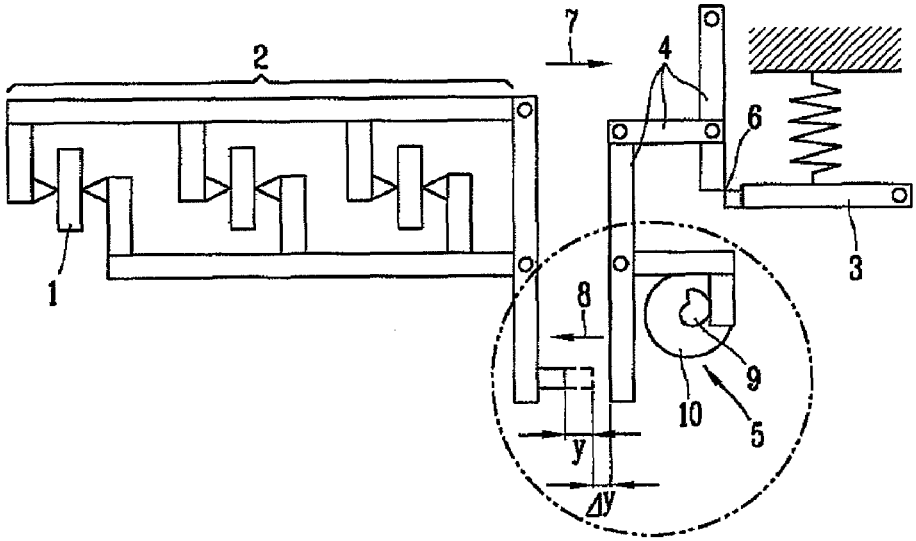
FIG. 1 RELATED ART
FIG. 1 is a diagram showing a configuration of a thermal overload trip apparatus in accordance with the related art.
Figure 2:
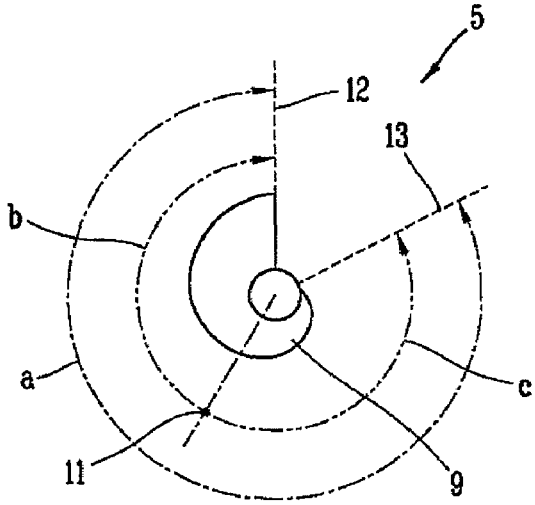
FIG. 2 RELATED ART
FIG. 2 is a diagram showing a relation between an adjusting cam and a trip sensitivity adjusting range in the thermal overload trip apparatus in accordance with the related art.
Figure 3:
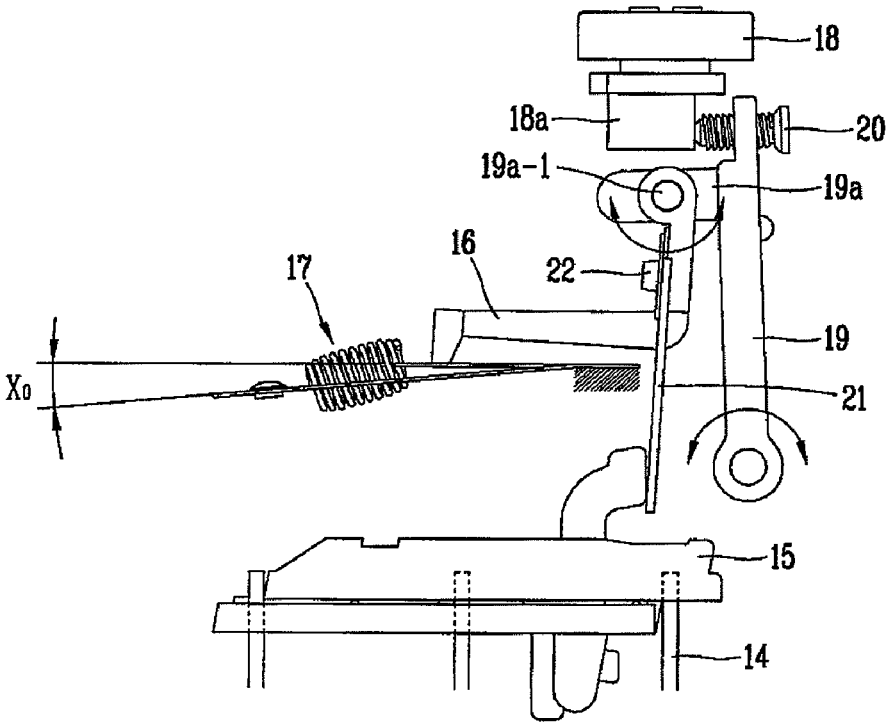
FIG. 3 is a diagram showing a configuration of a thermal overload trip apparatus in accordance with the present invention.
Figure 4:
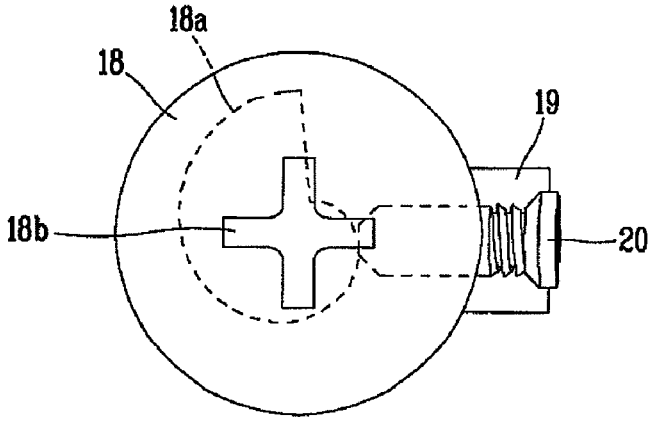
FIG. 4 is a planar view partially showing a relation between an adjusting cam and an adjusting screw for adjusting a trip sensitivity range in the thermal overload trip apparatus in accordance with the present invention.

FIG. 3 is a diagram showing a configuration of a thermal overload trip apparatus in accordance with the present invention, and FIG. 4 is a planar view partially showing a relation between an adjusting cam and an adjusting screw for adjusting a trip sensitivity range in the thermal overload trip apparatus in accordance with the present invention.

As shown in FIGS. 3 and 4, the thermal overload trip apparatus in accordance with the present invention includes bimetals 14. The bimetals 14 serve to provide a driving force for trip operation by winding of a heater coil (not shown) generating heat when an overcurrent is generated and then being bent when the heater coil generates heat. Preferably, three bimetals 14 are disposed to be connected onto each circuit of three-phase Alternating Current.

In FIG. 3, a reference numeral 15 designates a shifter mechanism for transferring a mechanical displacement of the bimetals 14 as a driving force. The shifter mechanism 15 includes upper and lower shifter plates (reference numeral not given) movable in a horizontal direction by pressure caused by bending the bimetals 14, and a rotation lever (reference numeral not given) rotatably supported by the upper and lower shifter plates so as to be rotated in a clockwise direction when the upper shifter plate is moved rightward and the lower shifter plate is moved leftward and to be rotated in a counterclockwise direction when the upper shifter plate is moved leftward and the lower shifter plate is moved rightward.

In FIG. 3, a reference numeral 17 designates a trip device driven to a trip position by the driving force from the shifter mechanism 15 when the overload is generated in the circuit. The trip device 17 includes a long leaf spring, a short leaf spring having a length half of the long leaf spring and having one end portion fixed with one end portion of the long leaf spring, and a coil spring having both end portions respectively supported by the long leaf spring and the short leaf spring. Accordingly, when a load is applied to the long leaf spring and the short leaf spring more than a pre-determined load, a free end portion of the long leaf spring is reversed to rise above a horizon from a state lower than the horizon. Here, the coil spring is bent. When the load applied to the trip device 17 is removed, the coil spring returns to the original state from the bent state. Accordingly, the long leaf spring is reversed to the state that the free end portion thereof is lower than the horizon.

Though it is not shown, one side of the reversing trip mechanism 17, particularly, the free end portion of the long leaf spring is connected with interlock to a switching mechanism for breaking the circuit through a trip operation, and accordingly the free end portion of the long leaf spring is reversed to be higher than the horizon, thereby performing the trip operation.

In FIG. 3, a release lever mechanism having one portion rotatably installed at a position contacting the shifter mechanism 15 so as to receive the driving force from the shifter mechanism 15 and another portion installed to contact the trip mechanism 17 is provided. The release lever mechanism, when an overload is generated in the circuit, is operated to drive the trip mechanism 17 to the trip position by pressing the trip mechanism 17 when there is the driving force from the shifter mechanism 15, while releases the trip mechanism 17 when there is no driving force from the shifter mechanism 15.

In FIG. 3, an adjusting lever 19 having a portion rotatably supporting the release lever mechanism is provided to operate the release lever mechanism to be horizontally moved by rotation.

The release lever mechanism includes a release lever 16 having one end rotatably supported by the adjusting lever 19 and another end contacting the trip mechanism 17, and a driving force transfer plate 21 having one end fixed to the release lever 16 and another end contacting the shifter mechanism 15 (more particularly, the rotation lever of the shifter mechanism 15). A reference numeral 22 is a fixing mechanism for fixing the driving force transfer plate 21 to the release lever 16. Particularly, the fixing mechanism 22 may include a protrusion protruded from the release lever 16, a fixing plate fitted into the protrusion, and fixing screws for fixing the driving force transfer plate 21 to the fixing plate.

The adjusting lever 19 is rotatable in a clockwise or counterclockwise direction centering a rotation shaft (reference numeral not given) coupled to a lower portion thereof. And, the adjusting lever 19 is provided with a portion rotatably supporting the release lever 16. The portion includes a supporting portion 19*a* extended from the upper portion thereof in a horizontal direction and a rotation shaft portion 19*a*-1 independently connected to the supporting portion 19*a* or integrated with the supporting portion 19*a*.

The thermal overload trip apparatus in accordance with the present invention has a configuration to set a sensitivity degree for the overload (overcurrent) in the circuit to perform the trip operation and adjust the sensitivity degree. As the configuration for rotatingly adjusting and setting a position for the trip operation according to a rated current, the configuration includes an adjusting knob 18 having an upper surface provided with a setting groove 18*b* and a lower portion provided with a cam portion 18*a*, and a means connected to the adjusting lever 19 so as to rotate the adjusting lever 19 and independently adjust a sensitivity to trip operation current regardless of manipulation of the adjusting knob 18.

The means includes an adjusting screw 20 connected to the adjusting lever 19 by a screw so as to rotate the adjusting lever 19 and adjust the sensitivity to trip operation current by independently adjusting a rotation angle of the release lever mechanism by the adjusting lever 19 regardless of manipulation of the adjusting knob 18. The adjusting screw 20 is a screw having a head portion provided with a manipulating groove to which a screw driver is connected and a body portion provided with a screw thread. An end portion of the body portion opposite to the head portion is installed to contact the cam portion 18*a* of the adjusting knob 18.

As shown in FIG. 4, upon rotatingly adjusting the adjusting knob 18 to the set adjusting groove 18*b* by connecting with a tool such as the screw driver, the end portion of the body portion of the adjusting screw 20 comes into contact with the cam portion 18*a* provided with a cam surface having a changing radius of an outer circumference of itself. Accordingly, the adjusting screw 20 is displaced in the horizontal direction according to the variation of the radius of the cam surface. That is, when the adjusting screw 20 contacts a portion of the cam portion 18*a* having a small radius of the cam surface, the adjusting screw 20 is moved leftward in FIG. 3. Accordingly, the adjusting lever 19 is rotated in the counterclockwise direction. When the adjusting screw 20 contacts a portion of the cam portion 18*a* having a large radius of the cam surface, the adjusting screw 20 is moved rightward in FIG. 3. Accordingly, the adjusting lever 19 is rotated in the clockwise direction. When the adjusting lever 19 is rotated in the counterclockwise direction, the driving force transfer plate 21 is rotated in the counterclockwise direction through the release lever 16 interposed therebetween thus to be distant from the shifter mechanism 15. Accordingly, the trip operation set current is increased and the trip operation sensitivity decreases. When the adjusting lever 19 is rotated in the clockwise direction, the driving force transfer plate 21 is rotated in the clockwise direction through the release lever 16 interposed therebetween thus to be closer to the shifter mechanism 15. Accordingly, the trip operation set current is decreased and the trip operation sensitivity increases.

The thermal overload trip apparatus in accordance with the present invention includes the adjusting screw 20 as a means for independently adjusting the sensitivity to the trip operation current regardless of manipulation of the adjusting knob 18. When the adjusting screw 20 is rotated in the clockwise direction by the screw driver, the adjusting screw 20 is rotated at its original position, but the upper portion of the adjusting lever 19 coupled to the adjusting screw 20 by a screw is horizontally moved rightward along the screw thread of the adjusting screw 20 in FIG. 3. Accordingly, the adjusting lever 19 is rotated in the clockwise direction centering a rotation shaft (reference numeral not given) at the lower portion thereof. When the adjusting screw 20 is rotated in the counterclockwise direction by the screw driver, the adjusting screw 20 is rotated at its original position, but the upper portion of the adjusting lever 19 coupled to the adjusting screw 20 by a screw is horizontally moved leftward along the screw thread of the adjusting screw 20 in FIG. 3. Accordingly, the adjusting lever 19 is rotated in the counterclockwise direction centering the rotation shaft (reference numeral not given) at the lower portion thereof. When the adjusting lever 19 is rotated in the counterclockwise direction, the driving force transfer plate 21 is rotated in the counterclockwise direction through the release lever 16 interposed therebetween thus to be distant from the shifter mechanism 15. Accordingly, the trip operation set current is increased and the trip operation sensitivity decreases. When the adjusting lever 19 is rotated in the clockwise direction, the driving force transfer plate 21 is rotated in the clockwise direction through the release lever 16 interposed therebetween thus to be closer to the shifter mechanism 15. Accordingly, the trip operation set current is decreased and the trip operation sensitivity increases. Accordingly, it is capable of independently setting and adjusting the trip operation current by the adjusting screw 20 regardless of manipulation of the adjusting knob 18 in accordance with the present invention.

In the meantime, when the bimetals 14 are bent rightward in FIG. 3 resulting from that the overcurrent in the circuit, an upper shifter of the shifter mechanism 15 is moved rightward and a lower shifter thereof remains at its original position, accordingly the rotation lever is rotated in the clockwise direction and thus the lower portion of the driving force transfer plate 21 is pressed. Accordingly, the driving force transfer plate 21 is rotated in the counterclockwise direction and then the release lever 16 connected to the upper portion of the driving force transfer plate 21 is rotated in the counterclockwise direction centering the rotation shaft portion 19*a*-1. Accordingly, the trip mechanism 17 is pressed by the end portion of the release lever 16. At a moment that the trip mechanism 17 is pressed to be rotated more than a trip operation initiation rotation angle $X_0$, the trip mechanism 17 is driven. Accordingly, the free end portion of the long leaf spring is moved up over the horizon. Thus, the switching mechanism (not shown) connected to the free end portion of the long leaf spring is operated to the trip position and then the circuit is broken, thereby protecting the circuit and the load device from the overcurrent.

In the meantime, a method for adjusting a trip sensitivity of the thermal overload trip apparatus in accordance with the present invention will be described with reference to FIGS. 5 and 6.

Figure 5:
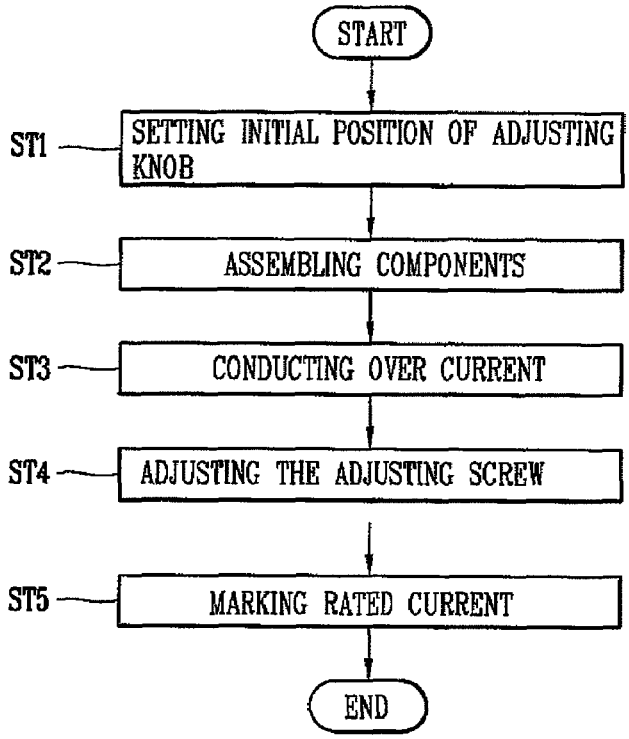
FIG. 5 is a flow chart showing a configuration of a method for adjusting a trip sensitivity of the thermal overload trip apparatus in accordance with the present invention.
Figure 6:
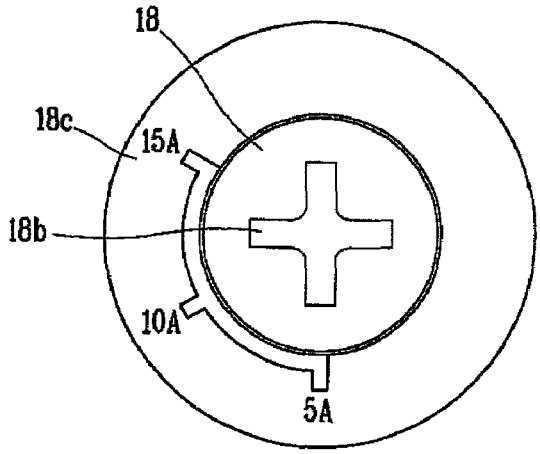
FIG. 6 is a planar view showing a graduation member installed at a periphery of an adjusting knob in the thermal overload trip apparatus in accordance with the present invention.

FIG. 5 is a flow chart showing a configuration of the method for adjusting the trip sensitivity of the thermal overload trip apparatus in accordance with the present invention, and FIG. 6 is a planar view showing a graduation member installed at a periphery of the adjusting knob in the thermal overload trip apparatus in accordance with the present invention.

The method for adjusting the trip sensitivity (hereafter, referred to as an adjusting method) of the thermal overload trip apparatus in accordance with the present invention may include: setting an initial position of the adjusting knob 18 (ST1); assembling components forming the thermal overload trip apparatus (ST2); conducting a predetermined overcurrent to the thermal overload trip apparatus assembled in the assembling step (ST2) during a predetermined time (ST3); adjusting the adjusting screw 20 by rotating the adjusting screw 20 until tripping occurs under a state that the adjusting knob 18 remains at its initially set position (ST4).

More particularly, the setting step (ST1) for the initial position of the adjusting knob is implemented by determining the initially-set position (that is, initial rotation angle) of the adjusting knob 18, according to the trip operation current performing the trip operation, to a predetermined position (angle).

The assembling step (ST2) is implemented by forming an assembly of the thermal overload trip apparatus by assembling the bimetals 14, the shifter mechanism 15, the trip mechanism 17, the release lever mechanism 16, the adjusting lever 19, the adjusting knob 18, the adjusting screw 20 and the like, components of the thermal overload trip apparatus in accordance with the present invention.

The overcurrent conducting step (ST3) is implemented by conducting the pre-determined overcurrent (trip operation current), having a predetermined increase value with respect to a rated current (e.g., 5A, 10A, 15A), to the thermal overload trip apparatus of the present invention during an allowable conducting time (e.g., 2 hours) specified in an international electrical standard or an international electrical safety standard. In other words, the step is to conduct a predetermined value of a test current during a predetermined allowable conducting time.

The adjusting screw adjusting step (ST4) is implemented by arbitrarily generating the trip operation by rotatingly adjusting the adjusting screw 20 thus to adjust the trip sensitivity under a state that the adjusting knob 18 remains at the initially-set position (initial rotation angle). Here, at a moment that the trip operation occurs, the adjusting of the trip sensitivity is completed.

The adjusting method of the thermal overload trip apparatus in accordance with the present invention further comprises a step of marking the rated current at a periphery of the adjusting knob (ST5).

The rated current marking step (ST5) is implemented by marking an additional rated current at the periphery of the adjusting knob under a state that the adjusting of the trip sensitivity is completed. In detail, in the rated current marking step (ST5) according to one embodiment, the rated current may be directly marked at the periphery of the adjusting knob 18.

Also, in the rated current marking step (ST5) according to another embodiment, the rated current (e.g., 5A, 10A, 15A) may be marked on a graduation member 18*c* installed at the periphery of the adjusting knob 18.

Therefore, according to the thermal overload trip apparatus and a method for adjusting the trip sensitivity thereof of the present invention, it is not required to disassemble and reassemble the components even if inferiority occurs while adjusting the trip operation sensitivity. Accordingly, the simplicity of simply adjusting the trip operation sensitivity is assured.

Further, the thermal overload trip apparatus in accordance with the present invention includes the means for independently adjusting the sensitivity to the trip operation current regardless of the cam portion, accordingly it is possible to adjust the sensitivity to the trip operation current without rotation of the adjusting knob.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A thermal overload trip apparatus, having bimetals for providing mechanical displacement according to an overload in a circuit and a shifter mechanism for transferring the mechanical displacement of the bimetals as a driving force, the apparatus comprising:

a trip mechanism driven to a trip position by the driving force from the shifter mechanism when the overload is generated on the circuit;

a release lever mechanism having one portion rotatably installed to contact the shifter mechanism so as to receive the driving force from the shifter mechanism and another portion installed to contact the trip mechanism, so that the release lever mechanism presses the trip mechanism and drive the trip mechanism to the trip position when there is the driving force from the shifter mechanism, or the release lever mechanism releases the trip mechanism when there is no driving force from the shifter mechanism, when the overload is generated in the circuit;

an adjusting lever having a portion for rotatably supporting the release lever mechanism so as to operate the release lever mechanism to be horizontally moved by the rotation;

an adjusting knob having an upper surface provided with a setting groove and a lower portion provided with a cam portion so as to set a trip operation position according to a rated current; and a means connected to the adjusting lever to rotate the adjusting lever so as to independently adjust a sensitivity to the trip operation current regardless of manipulation of the adjusting knob.

2. The apparatus of claim 1, wherein the means for independently adjusting the sensitivity of the trip operation current regardless of manipulation of the adjusting knob is an adjusting screw that installed to rotate the adjusting lever by being connected to the adjusting lever by a screw so as to independently adjust a rotation angle of the release lever mechanism through the adjusting lever regardless of manipulation of the adjusting knob, thus adjusting the sensitivity to the trip operation current.

3. The apparatus of claim 1, wherein the release lever mechanism comprises:

a release lever having one end rotatably supported by the adjusting lever and another end contacting the trip mechanism; and a driving force transfer plate having one end fixed to the release lever and another end contacting the shifter mechanism.

4. The apparatus of claim 1, wherein the portion for rotatably supporting the release lever mechanism of the adjusting lever comprises:

a portion extended from the adjusting lever in a horizontal direction; and a rotation shaft portion connected to the portion extended in the horizontal direction or integrated therewith.

5. A method for adjusting a trip sensitivity of a thermal overload trip apparatus, in the thermal overload trip apparatus comprising: bimetals for providing a mechanical displacement according to an overload in a circuit, a shifter mechanism for transferring the mechanical displacement of the bimetals as a driving force, a trip mechanism driven to a trip position by the driving force from the shifter mechanism when the overload is generated in the circuit, release lever mechanism having one portion rotatably installed to contact the shifter mechanism so as to receive the driving force from the shifter mechanism and another portion installed to contact the trip mechanism, so that the release lever mechanism presses the trip mechanism and drive the trip mechanism to the trip position when there is the driving force from the shifter mechanism, or the release lever mechanism releases the trip mechanism when there is no driving force from the shifter mechanism, when the overload is generated in the circuit, an adjusting lever having a portion for rotatably supporting the release lever mechanism so as to operate the release lever mechanism to be horizontally moved by the rotation, an adjusting knob having an upper surface provided with a setting groove and a lower portion provided with a cam portion so as to set a trip operation position according to a rated current, and an adjusting screw connected to the adjusting lever to rotate the adjusting lever so as to independently adjust sensitivity to the trip operation current regardless of manipulation of the adjusting knob, the method comprising:

setting an initial position of the adjusting knob;

assembling components forming the thermal overload trip apparatus;

conducting a predetermined overcurrent to the thermal overload trip apparatus assembled in the assembling step for a predetermined time; and adjusting the adjusting screw by rotating the adjusting screw until a trip operation occurs under a state that the adjusting knob is maintained at the initially set position.

6. The method of claim 5, further comprising marking the rated current at a periphery of the adjusting knob.

7. The method of claim 6, wherein the marking step is implemented by directly marking the rated current at the periphery of the adjusting knob.

8. The method of claim 6, wherein the marking step is implemented by marking the rated current on a graduation member installed at the periphery of the adjusting knob.

* * * * *